US005487190A

United States Patent [19]

Thompson

[11] Patent Number: 5,487,190

[45] Date of Patent: Jan. 30, 1996

[54] WORKMAN'S MATERIAL SUPPORT VEST FOR SUPPORTING CYLINDERS

[76] Inventor: Todd G. Thompson, 2923 North Pl., Oklahoma City, Okla. 73107

[21] Appl. No.: 253,997

[22] Filed: Jun. 3, 1994

[51] Int. Cl.[6] ..... A41D 1/04

[52] U.S. Cl. ..... 2/102; 2/51; 2/49.1; 2/49.2

[58] Field of Search ..... 2/102, 94, 108, 2/85, 93, 51, 49.1, 49.2, 1, 2; 224/223

[56] References Cited

U.S. PATENT DOCUMENTS

| | | | |
|---|---|---|---|
| 144,594 | 11/1873 | Black | 2/94 |
| 168,622 | 10/1875 | Daigre | 2/94 |
| 466,298 | 12/1891 | Dean | 2/94 |
| 487,556 | 12/1892 | Dudley | 2/94 |
| 725,903 | 4/1903 | Wilcomb | 2/94 |
| 4,369,526 | 1/1983 | Clutts | 2/102 |
| 4,564,957 | 1/1986 | Scharf | 2/94 |
| 4,602,387 | 7/1986 | Zakrzewski | 2/102 |
| 5,247,707 | 9/1993 | Parker et al. | 2/102 |
| 5,331,683 | 7/1994 | Stone et al. | 2/102 |

*Primary Examiner*—C. D. Crowder
*Assistant Examiner*—Gloria Hale
*Attorney, Agent, or Firm*—Robert K. Rhea

[57] ABSTRACT

A caulking tube supporting vest is formed by front and back fabric panels substantially covering a user's torso and secured at their depending edges by straps at respective sides of a user. A vertical series of horizontally disposed open end sleeves formed from elastic fabric material are secured to the respective front and back panel for receiving a like plurality of cylindrical containers filled with caulking.

1 Claim, 1 Drawing Sheet

WORKMAN' S MATERIAL SUPPORT VEST FOR SUPPORTING CYLINDERS

BACKGROUND OF THE INVENTION

1. Field of the Invention

This invention relates to painting and frame building upkeep and more particularly to a workman's caulking tube support vest.

Wood frame buildings periodically require repainting in order to prolong the life of the building. In order to prolong the life of a paint job, it is necessary that cracks and spaces be caulked or recaulked to preclude the entry of moisture into the wood of the structure which if not excluded will result in paint peeling or blistering due to the heat of sun rays drawing moisture out of the wood.

In order to adequately caulk a building prior to painting, it is usually necessary to employ the use of a step ladder to reach elevated areas. Since each tube of caulk contains a relatively small amount of caulking, on the order of seven to nine ounces, it is frequently necessary to descend the ladder and obtain a fresh tube of caulking which is a tiresome and time consuming part of caulking the upper portion of a frame building.

This invention provides a vest-like garment having a plurality of caulking tube containing sleeves or openings so the workman may caulk all areas reachable from the position of the ladder without the necessity of descending to the surface of the earth to obtain additional tubes of caulking for one location.

2. Description of the Prior Art

I do not know of any patent disclosing a workman's material supporting vest such as disclosed by this invention.

SUMMARY OF THE INVENTION

A caulking tube supporting open-side vest-like garment is formed by a length of fabric having a central opening for receiving the head of a user and supporting the garment from his shoulders. The garment comprises back and front panel user torso covering portions extending downwardly to approximately the user's belt line and releasably joined together at depending adjacent edges at either side of a user. Each front and back panel is provided with a vertical series of sleeve-like openings disposed in superposed horizontal relation for receiving a like plurality of ready-to-be-used cylindrical tubes of caulking.

The principal object of this invention is to provide a workman's material support vest having a plurality of caulking tube receiving sleeves thereon for extending the amount of caulking available for caulking a given location of a dwelling such as a frame building.

Figure 1:
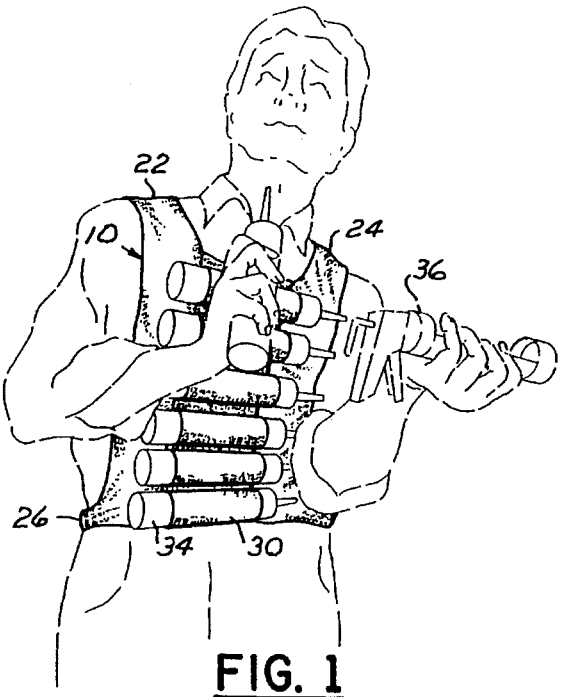
FIG. 1 is a perspective front view of the vest in place on a user and filled with caulking tubes.
Figure 2:
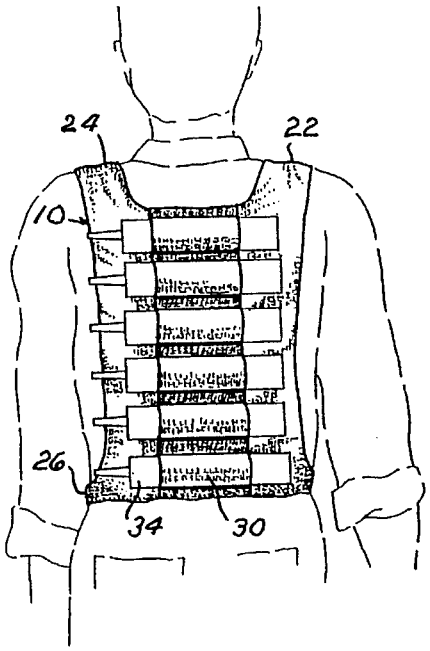
FIG. 2 is a rear elevational view of the vest and its relative position on a user.
Figure 3:
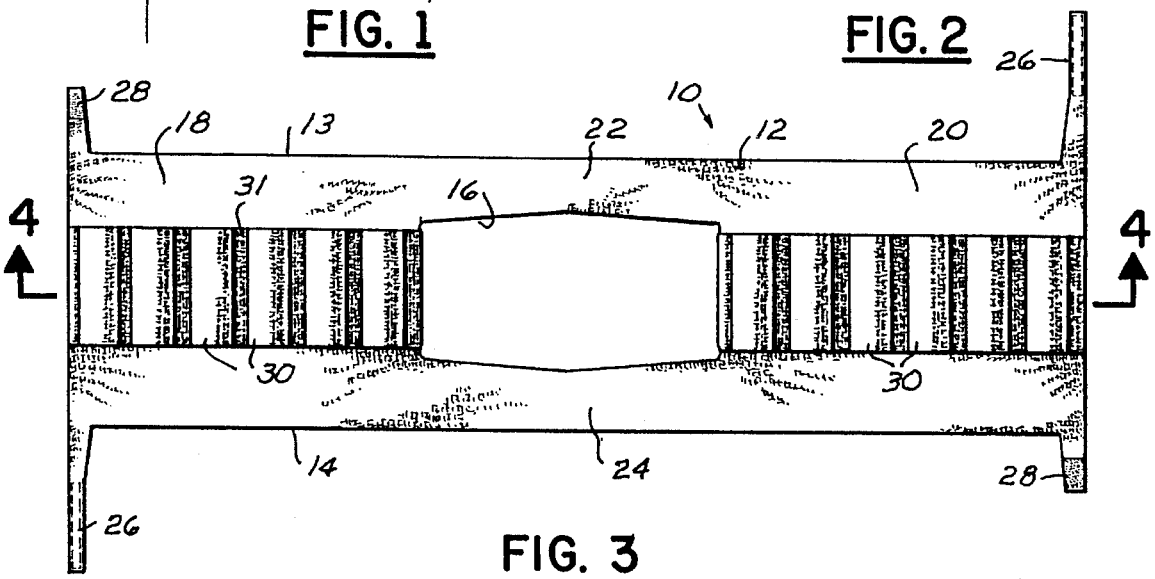
FIG. 3 is a top plan view of the vest, per se.
Figure 4:
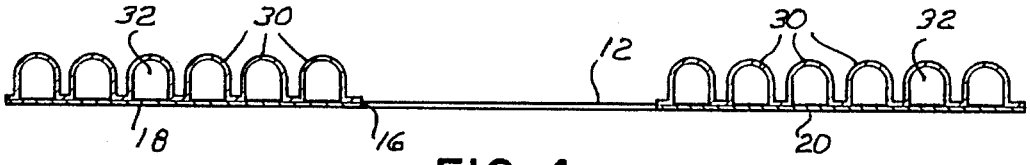
FIG. 4 is a vertical cross sectional view taken substantially along the line 4—4 of FIG. 3.

The reference numeral 10 indicates the vest comprising a selected length of preferably non-stretchable cloth fabric having an outer surface 12 and parallel side edges 13 and 14. Medially its length and width the fabric is provided with a substantially rectangular opening 16 having a width and length for freely receiving the head of a user and delineating its rectangular end portions 18 and 20, hereinafter referred to as front and back torso covering "panels". The opening 16 defines a pair of shoulder straps 22 and 24 which support the vest 10 when placed over the shoulders of a user.

The length of the panels 18 and 20 is such that the respective ends terminate at approximately the waistline of the user. The panels 18 and 20 are each provided, at their depending end limit, with laterally extending cooperating straps 26 having self adhesive hook and eye material thereon, such as VELCRO 28 for releasably securing the respective side edges of the front and back panels together on either side of the user when the vest is in use.

Medially the width and throughout its length each front and back panel, between its depending edge and the adjacent end limit of the neck opening 16, is provided with a series of juxtaposed open end sleeve members 30 formed from elastic fabric material 31 defining a like plurality of openings 32 snugly surrounding the major intermediate portion of conventional cylinderical caulking tubes 34.

OPERATION

In operation the sleeves 30 of the vest are filled with a like plurality of tubes of caulking 34. The vest is then placed on the user's shoulders and the VELCRO hook and loop fastener equipped straps 26 are secured together at either side of the vest garment to maintain the panels in place.

As a user progressively empties one of the cartridges 34 he may replace the empty cartridge in an empty sleeve and remove a second or subsequent tube of caulking and place it in a caulking gun 36.

Obviously the invention is susceptible to changes or alterations without defeating its practicability. Therefore, I do not wish to be confined to the preferred embodiment shown in the drawings and described herein.

I claim:

1. A caulking tube supporting vest, comprising:

an elongated length of non-stretchable fabric having end edges and parallel sides edges and having a substantially rectangular user's head receiving opening medially the fabric length and width for forming parallel shoulder straps and front and back panels each having an outer surface and partially covering a user's torso when placed over the shoulders of a user;

releasable strap means joining the end edges of the front and back panels to each other at respective sides of a user; and, a selected width and length of elastic fabric secured to the outer surface of each said front and back panel medially the width of the respective panel and between the respective said end edge and the head opening to form, in combination with the respective panel, a series of horizontally disposed juxtaposed open end caulking tube receiving sleeves.

* * * * *